US010775096B2

(12) United States Patent
Ha et al.

(10) Patent No.: US 10,775,096 B2
(45) Date of Patent: Sep. 15, 2020

(54) REFRIGERATOR

(71) Applicant: Samsung Electronics Co., Ltd., Suwon-si, Gyeonggi-do (KR)

(72) Inventors: Joo-Young Ha, Suwon-si (KR); Kook Jeong Seo, Seoul (KR); Ji-Young Lee, Yongin-si (KR); Jeong Su Han, Suwon-si (KR); Ji Yun Yeo, Seoul (KR); Sang Tak Lee, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 230 days.

(21) Appl. No.: 15/841,112

(22) Filed: Dec. 13, 2017

(65) Prior Publication Data

US 2018/0164028 A1 Jun. 14, 2018

(30) Foreign Application Priority Data

Dec. 13, 2016 (KR) ..... 10-2016-0169658

(51) Int. Cl.
*F25D 23/02* (2006.01)
*B65B 31/04* (2006.01)
*F25D 23/12* (2006.01)

(52) U.S. Cl.
CPC ..... *F25D 23/028* (2013.01); *B65B 31/04* (2013.01); *F25D 23/12* (2013.01)

(58) Field of Classification Search
CPC ..... B65B 31/04; B65B 31/046; B65B 31/047; B65B 31/048; B65B 31/06; B65D 81/2023; B65D 81/203; B65D 81/2038; F25D 2317/043; F25D 2331/801; B25J 13/081
USPC ... 53/405, 408, 427, 432, 434, 510, 512, 79, 53/88; 99/454, 472; 62/170, 60, 100
See application file for complete search history.

(56) References Cited

U.S. PATENT DOCUMENTS 5,215,445 A * 6/1993 Chen ..... B65B 31/06 417/313
5,765,608 A * 6/1998 Kristen ..... B65B 31/047 141/198
7,331,163 B2 2/2008 Hau et al.
7,389,629 B2 * 6/2008 Tretina ..... F04C 25/00 141/65
8,191,469 B2 * 6/2012 Bergman ..... B65D 81/2038 206/524.8
2003/0140603 A1 * 7/2003 Krasenics, Jr. ..... B65B 31/046 53/434

(Continued)

FOREIGN PATENT DOCUMENTS

EP 1619455 B1 4/2014

*Primary Examiner* — Stephen F. Gerrity
*Assistant Examiner* — Joshua G Kotis

(57) ABSTRACT

Disclosed herein is a refrigerator including a vacuum packing device. The refrigerator includes a body and a vacuum packing device provided in the body and configured to suction air in a vinyl pack having a check valve, wherein the vacuum packing device includes a vacuum pump provided to suction the air, a switch module provided to control an operation of the vacuum pump, a suction head including a first path directly connected to the check valve and configured to suction the air, and a chamber including a first opening connected to the first path and provided to collect a foreign substance suctioned through the suction head.

18 Claims, 11 Drawing Sheets

(56) References Cited

U.S. PATENT DOCUMENTS

| | | | | |
|---|---|---|---|---|
| 2005/0102975 | A1* | 5/2005 | Hughes | B65B 31/042 53/432 |
| 2005/0172834 | A1* | 8/2005 | Lee | B65B 31/046 99/472 |
| 2006/0230711 | A1* | 10/2006 | Higer | B65B 31/048 53/512 |
| 2006/0254219 | A1* | 11/2006 | Alipour | B29C 65/18 53/434 |
| 2007/0290588 | A1* | 12/2007 | Oh | F16M 11/04 312/401 |
| 2008/0308177 | A1* | 12/2008 | Thuot | B65B 31/04 141/65 |
| 2009/0193760 | A1* | 8/2009 | Leclear | B65B 31/046 53/434 |
| 2010/0089963 | A1* | 4/2010 | Franz | B25C 1/06 227/8 |
| 2010/0218461 | A1* | 9/2010 | Borchardt | B65B 31/047 53/432 |
| 2010/0273622 | A1* | 10/2010 | Vonderhaar | B65B 1/02 493/267 |
| 2011/0126986 | A1* | 6/2011 | Cheung | B29C 66/1122 156/350 |
| 2016/0101884 | A1* | 4/2016 | Picozza | B65B 31/047 53/52 |

* cited by examiner

REFRIGERATOR

CROSS-REFERENCE TO RELATED APPLICATION AND CLAIM OF PRIORITY

This application is related to and claims priority to Korean Patent Application No. 10-2016-0169658, filed on Dec. 13, 2016, the contents of which are incorporated herein by reference.

TECHNICAL FIELD

Embodiments of the present disclosure relate to a refrigerator including a vacuum packing device.

BACKGROUND

In general, a refrigerator is one of household appliances including a storage compartment configured to store food and a cold air supply device configured to supply cold air to the storage compartment to freshly store the food.

The storage compartment can include a freezer compartment maintained at a temperature lower than or equal to the freezing point and a refrigerator compartment maintained at a temperature relatively higher than the temperature of the freezer compartment.

Meanwhile, when food stored in the refrigerator compartment is stored for a long time, freshness of the food can be degraded. Accordingly, although a method of storing and freezing food in the freezer compartment can be used to store the food for a long time, flavor of the food can be degraded when the food is stored in the freezer compartment.

Accordingly, a method of storing vacuum packaged food using a vacuum packing device configured to remove air causing food decomposition has been used.

SUMMARY

To address the above-discussed deficiencies, it is a primary object to provide a refrigerator including a vacuum packing device.

It is another aspect of the present disclosure to provide a refrigerator including a vacuum packing device directly connected to a vinyl pack without a separate hose and configured to remove air in the vinyl pack.

It is still another aspect of the present disclosure to provide a refrigerator including a vacuum packing device operated only by a contact with a vinyl pack so as to be conveniently used.

It is yet another aspect of the present disclosure to provide a refrigerator including a vacuum packing device configured to prevent a foreign substance in a vinyl pack from being introduced into a vacuum pump with air.

Additional aspects of the disclosure will be set forth in part in the description which follows and, in part, will be obvious from the description, or may be learned by practice of the disclosure.

In accordance with one aspect of the present disclosure, a refrigerator includes a body and a vacuum packing device provided in the body and configured to suction air in a vinyl pack having a check valve, wherein the vacuum packing device includes a vacuum pump provided to suction the air, a switch module provided to control an operation of the vacuum pump, a suction head including a first path directly connected to the check valve and configured to suction the air, and a chamber including a first opening connected to the first path and provided to collect a foreign substance suctioned through the suction head.

The switch module may include a button configured to pass through the first path and protrude to an outside of the suction head, the vacuum pump may be provided to operate when the button is pressed.

The vacuum packing device may further include a tube configured to connect the chamber and the vacuum pump while forming a second path.

The chamber may further include a second opening connected to the tube, and the second opening is provided at a higher level than the first opening.

The first opening and the second opening may be respectively formed in one surface of the chamber and the other surface thereof opposite the one surface.

The switch module may further include an elastic member configured to elastically bias the button to protrude to the outside of the suction head.

The refrigerator may further include a door including a dispenser provided to supply water, and rotatably coupled to the body, wherein the vacuum packing device may be provided at one side of the dispenser.

A diameter of the first path may be provided to be greater than a diameter of the button so that the air flows in a space between the first path and the button.

The suction head may be detachably coupled to the chamber so that the foreign substance is removable in the chamber.

The suction head may include a material having elasticity and may be provided to be forcibly insertion-coupled to the chamber.

The vacuum packing device may further include an inner case in which the vacuum pump, the chamber, and the switch module are disposed, and an outer case in which the inner case and the suction head are disposed, wherein the outer case may include a cover door provided to be slidable in front of the suction head.

The vacuum packing device may further include a support member provided to fix the inner case to an inner side of the outer case, and the support member may include brackets provided on both sides of the support member, and an elastic member disposed between the brackets and the inner case.

The switch module may include a button disposed outside the vacuum packing device and provided to turn the vacuum pump on and off.

The tube may include an inlet into which the air is introduced and an outlet from which the air is discharged, and a first direction in which the air is introduced into the inlet may be opposite a second direction in which the air is discharged from the outlet.

In accordance with another aspect of the present disclosure, a refrigerator includes a body, a door rotatably coupled to the body, and a vacuum packing device provided in the door configured to suction air in a vinyl pack having a check valve, wherein the vacuum packing device includes a vacuum pump, a suction head configured to suction the air in the vinyl pack, and a chamber including a first opening connected to the suction head so that the air introduced through the suction head flows in the suction head, and a second opening connected to the vacuum pump to discharge the air introduced into the first opening and provided at a higher level than the first opening.

The suction head may be provided to be directly connected to the check valve.

The vacuum packing device may further include a switch module including a button configured to pass through the suction head and protrude to an outside of the suction head.

The vacuum pump may be provided to operate when the button is pressed.

The door may further include a dispenser provided to supply water to an outside of the door, and the suction head may be disposed on the dispenser.

In accordance with still another aspect of the present disclosure, a refrigerator includes a vacuum packing device provided to suction air in the vinyl pack, wherein the vacuum packing device includes a vacuum pump, a suction head directly connected to the vinyl pack and provided to suction the air, and switch module including a button configured to pass through the suction head and protrude to an outside of the suction head, and provided to operate the vacuum pump when the button is pressed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
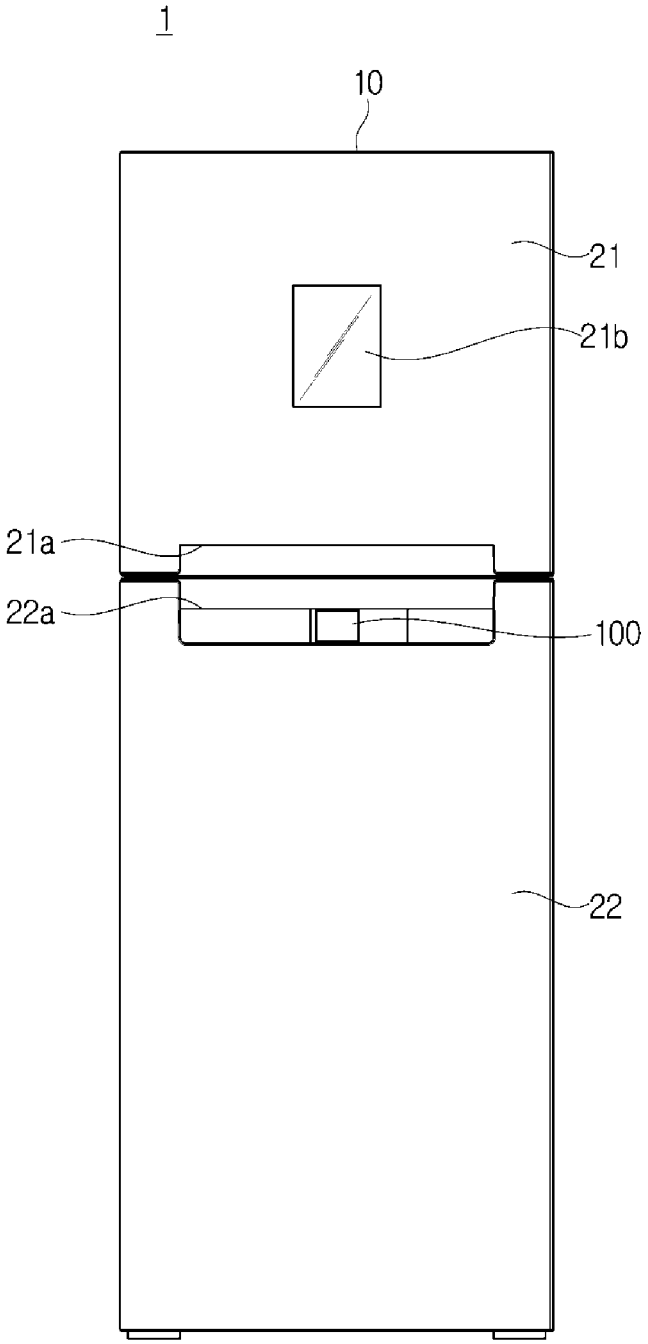
FIG. 1 is a view illustrating an exterior of a refrigerator according to one embodiment of the present disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Further, identical symbols or numbers in the drawings of the present disclosure denote components or elements configured to perform substantially identical functions.

Further, terms used herein are for the purpose of describing particular embodiments only and are not intended to limit to the present disclosure. As used herein, the singular forms "a," "an," and "the" are intended to include the plural forms as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms first, second, etc. may be used herein to describe various elements, these elements are not limited by the terms, and the terms are only used to distinguish one element from another. For example, a first element could be termed as a second element, and similarly, a second element could be termed as a first element without departing from the scope of the present disclosure. As used herein, the term "and/or" includes combinations of one or more of a plurality of associated listed items or any and all items among the plurality of associated listed items.

Hereinafter, the embodiments according to the present disclosure will be described in detail with reference to the accompanying drawings.

FIG. 1 is a view illustrating an exterior of a refrigerator according to one embodiment of the present disclosure.

As shown in FIG. 1, a refrigerator 1 may include body 10 and upper and lower doors 21 and 22 rotatably coupled to the body 10.

A storage compartment (not shown) may be provided in the body 10 and may include a refrigerator compartment (not shown) and a freezer compartment (not shown).

The upper door 21 may be provided to open and close the freezer compartment, and the lower door 22 may be provided to open and close the refrigerator compartment.

A display 21B may be provided on the upper door 21. The display 21B may display a temperature and various states of the refrigerator 1.

A handle portion 21A may be provided on a lower portion of the upper door 21 to open and close the upper door 21. Likewise, a handle portion 22A may be provided on an upper portion of the lower door 22 to open and close the lower door 22.

Figure 10:
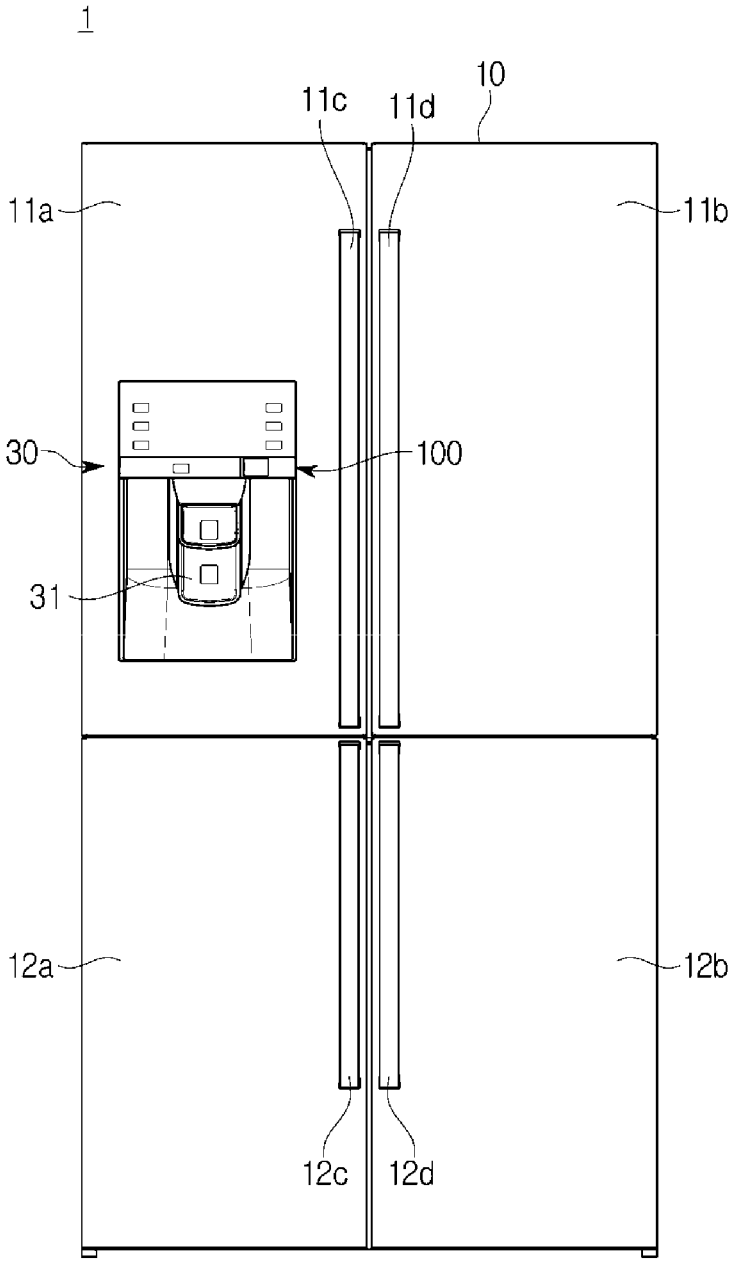
FIG. 10 is a view illustrating an exterior of a refrigerator according to another embodiment of the present disclosure.

A vacuum packing device 100 may be provided in the lower door 22. The vacuum packing device 100 may be provided at a side of the handle portion 22A. However, the above is only one example, and the vacuum packing device 100 may be provided in the upper door 21. Alternatively, the vacuum packing device 100 may be provided at another location of the lower door 22. In addition, the vacuum packing device 100 may be mounted on various refrigerators including the refrigerator shown in FIG. 1. For example, as shown in FIG. 10, the vacuum packing device 100 may be applied to a three-door or four-door French door refrigerator (FDR) type refrigerator in which a refrigerator compartment is provided in an upper portion thereof, a freezer compartment is provided in a lower portion thereof, and the refrigerator compartment opens in a lateral direction toward both sides thereof. Such a structure will be described below.

Figure 2:
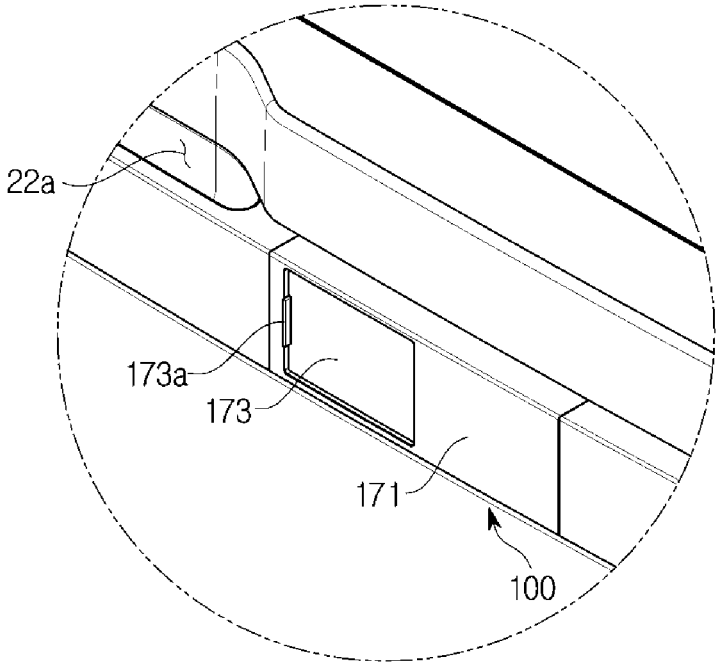
FIG. 2 is an enlarged view illustrating a portion at which a vacuum packing device is provided in the refrigerator in FIG. 1.
Figure 3:
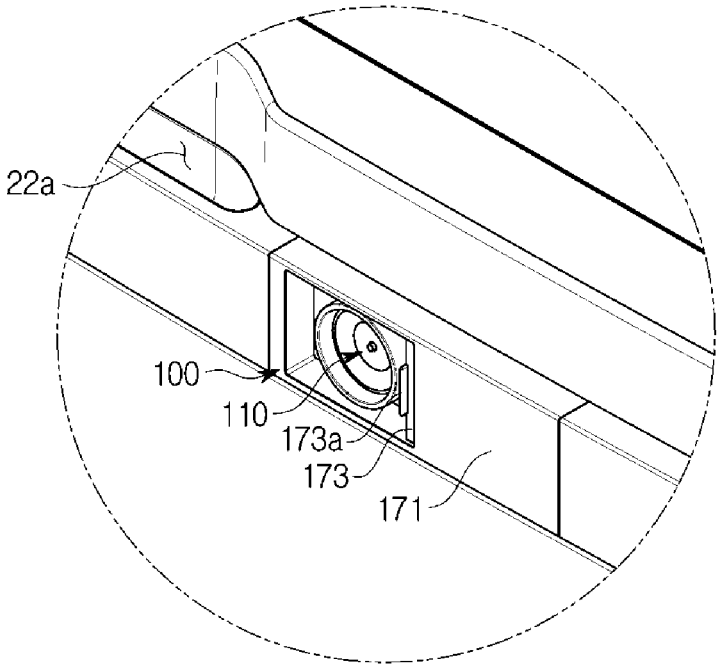
FIG. 3 is a view in which a cover door of the vacuum packing device illustrated in FIG. 2 is open.

FIG. 2 is an enlarged view illustrating a portion at which a vacuum packing device is provided in the refrigerator in FIG. 1, and FIG. 3 is a view in which a cover door of the vacuum packing device illustrated in FIG. 2 is open.

As shown in FIGS. 2 and 3, the vacuum packing device 100 may be disposed on a front surface of the lower door 22 so that a part thereof is exposed. Specifically, an outer case 170 of the vacuum packing device 100 may be disposed on an upper portion of the front surface of the lower door 22 so that a part of the outer case 170 is exposed to the outside.

The vacuum packing device 100 may include a cover door 173 provided to be slidable on a first outer case 171. The cover door 173 may form a part of an exterior of the lower door 22. The cover door 173 may be provided to cover a suction head 110 so that the suction head 110 of the vacuum packing device 100 is not visible from the outside when a user does not use the vacuum packing device 100. Since the cover door 173 is provided to be slidable on the first outer case 171, the user may expose the suction head 110 to the outside of the lower door 22 by gripping and sliding a cover door handle 173A provided on the cover door 173 when the vacuum packing device 100 is used.

As described above, according to an aspect of the present disclosure, the vacuum packing device 100 is provided with the cover door 173 so as not to spoil the beauty of the refrigerator. That is, although the vacuum packing device 100 is provided in the door, an exterior of the refrigerator 1 is not affected by the vacuum packing device 100 because the vacuum packing device 100 is not a disadvantageous factor during design.

Further, according to the aspect of the present disclosure, the vacuum packing device 100 may be used without opening the refrigerator door. Conventionally, since a vacuum packing device is provided in a refrigerator home-bar, loss of cold air occurs during vacuum-packing. As described above, according to the embodiment of the present disclosure, since the vacuum packing device 100 is provided to be operated without opening the refrigerator door, the loss of cold air does not occur.

Figure 4:
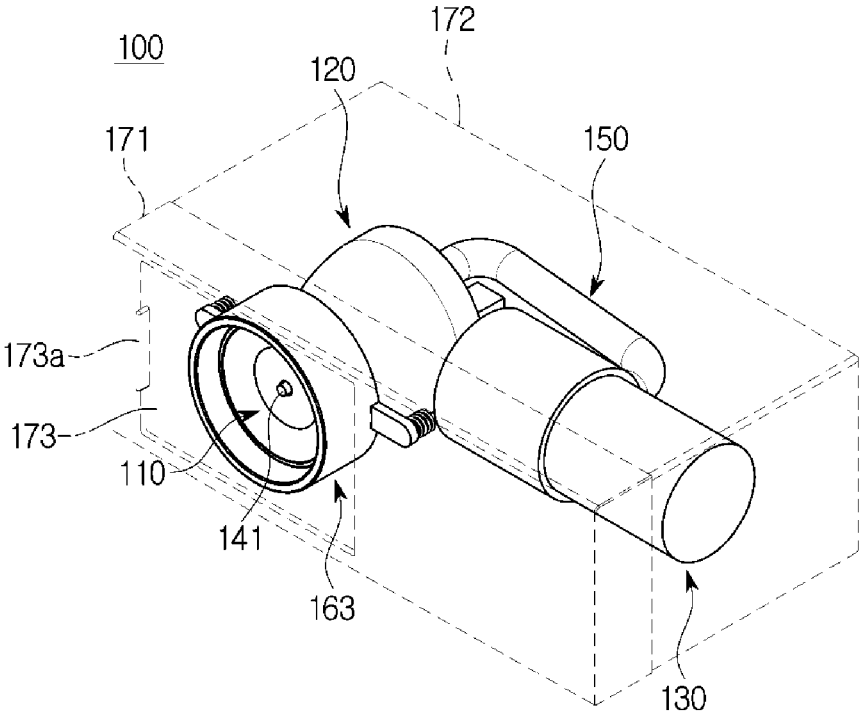
FIG. 4 is a view illustrating the vacuum packing device in the refrigerator according to one embodiment of the present disclosure.
Figure 5:
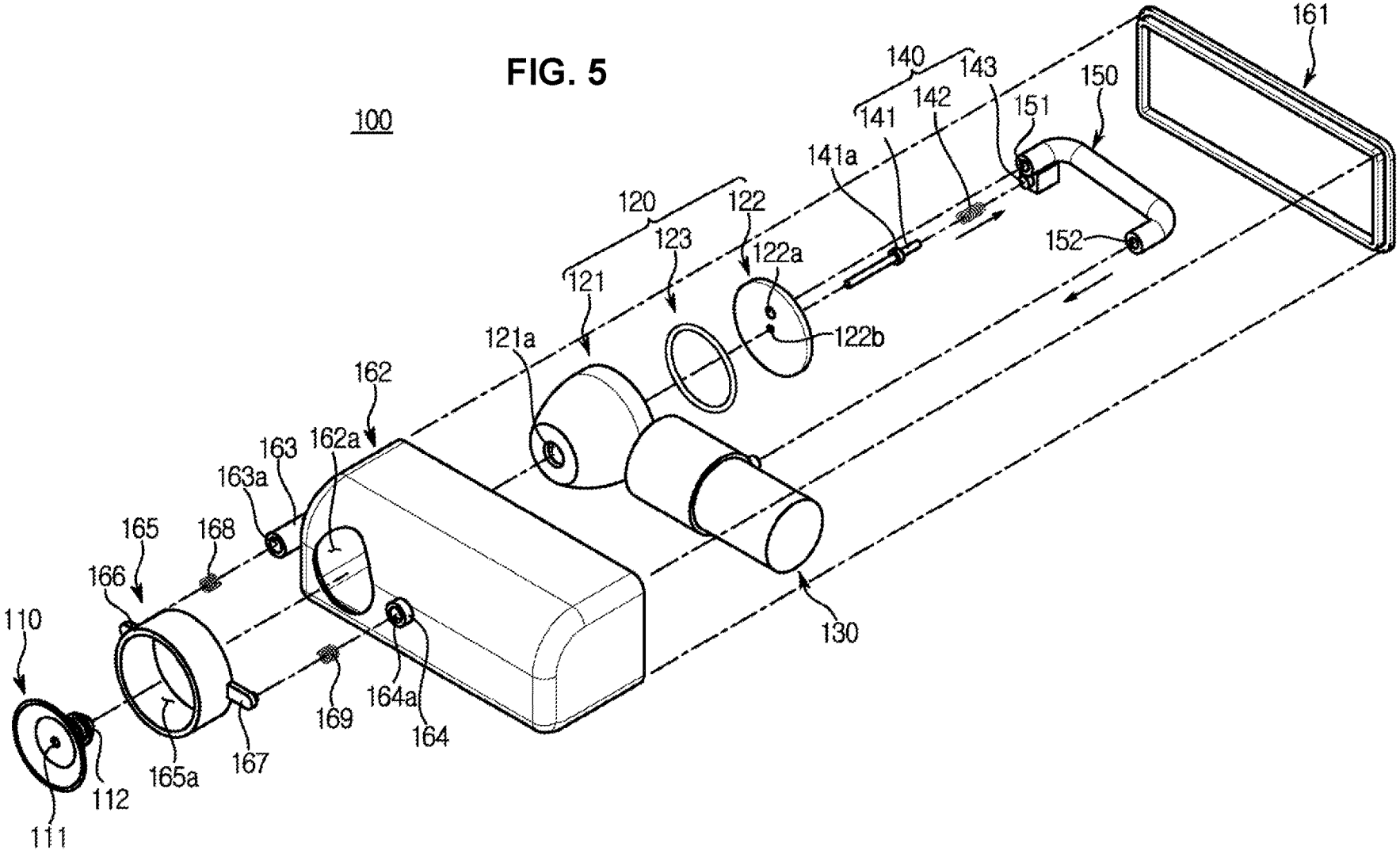
FIG. 5 is an exploded perspective view of the vacuum packing device illustrated in FIG. 4.

FIG. 4 is a view illustrating the vacuum packing device in the refrigerator according to one embodiment of the present disclosure. FIG. 5 is an exploded perspective view of the vacuum packing device illustrated in FIG. 4.

Hereinafter, a configuration of the vacuum packing device 100 will be described in detail.

The outer case 170 is shown by a dotted line in FIG. 3 for convenience of description.

As shown in FIGS. 3 and 4, the vacuum packing device 100 may include the outer case 170 forming an exterior of the vacuum packing device 100.

The outer case 170 may include the first outer case 171 and a second outer case 172.

The first outer case 171 may form a front surface of the outer case 170, and the second outer case 172 may form a rear surface of the outer case 170.

The cover door 173 may be coupled to the first outer case 171 to be slidable. The cover door 173 may be provided in front of the suction head 110. Accordingly, the suction head 110 may be exposed to an outside of the outer case 170 by sliding.

The cover door handle 173A may be provided on one side of the cover door 173. A user may grip the cover door handle 173A and slide the cover door 173.

The vacuum packing device 100 may include the suction head 110, a chamber 120, a vacuum pump 130, and a switch module 140.

The suction head 110 may come into direct contact with a vinyl pack 200 (see FIG. 6) and may be provided to suction air in the vinyl pack 200. That is, the suction head 110 may be connected to a check valve 210 of the vinyl pack 200 without a separate connection member, such as a hose, to suction the air in the vinyl pack 200. Such a connection will be described below.

The suction head 110 may include a suction port 111 through which air is suctioned, a discharge port 114 through which the air suctioned into the suction port 111 is discharged, and a first path 113 provided between the suction port 111 and the discharge port 114.

The suction port 111 may be provided to correspond to an opening and closing hole 211 of the vinyl pack 200. The suction head 110 may suction the air in the vinyl pack 200 through the opening and closing hole 211 and the suction port 111.

The suction head 110 may include a coupler 112 provided to be insertion-coupled to the chamber 120. The suction head 110 may be formed of a flexible material. Accordingly, the coupler 112 may be forcibly insertion-coupled to the chamber 120 even when a diameter of the coupler 112 is provided to be larger than that of an insertion port 121A of the chamber 120.

The chamber 120 may include a chamber body 121, a chamber plate 122 coupled to the chamber body 121 and forming a rear wall of the chamber 120, and a sealing member 123 provided to seal a gap between the chamber body 121 and the chamber plate 122.

The chamber body 121 may include the insertion port 121A into which the coupler 112 of the suction head 110 is inserted. The insertion port 121A may be formed in a front surface of the chamber body 121.

A fixing portion may be provided in the chamber body 121. The fixing portion may form a space into which the coupler 112 is inserted. The insertion port 121A may be provided in a front surface of the fixing portion, and a first opening 121B may be provided in a rear surface of the fixing portion.

A rear surface of the chamber body 121 may be open. The chamber 120 may include the chamber plate 122 provided to cover the open rear surface of the chamber body 121. However, the chamber 120 is not limited thereto, and the chamber body 121 and the chamber plate 122 may be integrally formed to form the chamber 120.

The chamber plate 122 may include a second opening 122A and a third opening 122B provided behind the second opening 122A.

The second opening 122A may be provided to correspond to an inlet 151 of a tube 150. The third opening 122B may be provided so that a button 141 of the switch module 140 is inserted thereinto.

The sealing member 123 may be provided to seal the gap between the chamber body 121 and the chamber plate 122. When the chamber plate 122 is coupled to the chamber body 121, a suction force of the vacuum packing device 100 may be lowered due to the gap between the chamber body 121 and the chamber plate 122. The sealing member 123 may be provided to seal the gap. Since the sealing member 123 is provided, air may be prevented from leaking through an edge of a rear surface of the chamber 120 even when the chamber body 121 and the chamber plate 122 are not integrally formed.

Meanwhile, since the chamber 120 is divided into the chamber body 121 and the chamber plate 122 which are detachable, a user may easily remove a foreign substance in the chamber 120. That is, the chamber plate 122 may be separated from the chamber body 121 to remove the foreign substance in the chamber 120. A removal of a foreign substance will be described in detail below.

The vacuum pump 130 may be provided to suction air. A type of the vacuum pump 130 has no limitation. That is, as long as a pump is provided to suction air, there is no limitation on a type or shape of the pump.

The switch module 140 may be provided to control an operation of the vacuum pump 130.

The switch module 140 may include the button 141, an elastic member 142, and a switch 143.

The button 141 may be provided to have a bar shape. The button 141 may be provided to pass through the first path 113 and protrude to an outside of the suction head 110. The button 141 may be provided to have length longer than a length in a front-rear direction of the chamber 120.

The button 141 may include an engaging portion 141A provided so that the first elastic member 142 is engaged therewith. A diameter of the engaging portion 141A may be provided to be greater than that of the remaining portion of the button 141.

The switch 143 may be provided to operate the vacuum pump 130 when pressed. That is, the switch 143 may be provided to operate the vacuum pump 130 when being pressed by the button 141. When the button 141 does not press the switch 143, the vacuum pump 130 may be provided to stop the operation thereof.

The first elastic member 142 may be disposed between the button 141 and the switch 143. One end of the first elastic member 142 may be supported by the engaging portion 141A of the button 141, and the other end of the first elastic member 142 may be supported by the switch 143. The first elastic member 142 elastically biases the button 141 so that one end of the button 141 protrudes to an outside of the suction port 111. Accordingly, when a user does not press the one end of the button 141 with a force greater than or equal to an elastic restoring force of the first elastic member 142, the one end of the button may protrude to the outside of the suction port 111 due to the elastic restoring force of the first elastic member 142.

The vacuum packing device 100 may further include the tube 150 provided to connect the chamber 120 and the vacuum pump 130.

The tube 150 may include the inlet 151 into which air is introduced, an outlet 152 from which the air is discharged, and a second path 153 provided between the inlet 151 and the outlet 152.

The inlet 151 may be connected to the second opening 122A of the chamber plate 122.

A first direction in which the air is introduced into the inlet 151 may be opposite a second direction in which the air is discharged from the outlet 152.

The vacuum packing device 100 may include the chamber 120, the vacuum pump 130, the switch module 140, and an inner case 160 in which the tube 150 is disposed.

The inner case 160 may include a first inner case 161 and a second inner case 162.

The first inner case 161 may form a rear surface of the inner case 160.

The second inner case 162 may include an opening 162A provided to allow a part of the chamber 120 to pass therethrough, and a first supporter 163 and a second supporter 164 provided at both sides of the opening 162A.

An opening 163A may be provided in a front surface of the first supporter 163, and an opening 164A may be provided in a front surface of the second supporter 164.

A second elastic member 168 may be inserted into the opening 163A of the first supporter 163, and a third elastic member 169 may be inserted into the opening 164A of the second supporter 164.

The vacuum packing device 100 may further include a support member 165 coupled to the inner case 160 and provided to fix the inner case 160 to one side of the outer case 170.

A first bracket 166 and a second bracket 167 may be provided on both sides of support member 165.

The second elastic member 168 may be coupled to the first bracket 166, and the third elastic member 169 may be coupled to the second bracket 167.

That is, one end of the second elastic member 168 may be supported by the first supporter 163, and the other end of the second elastic member 168 may be supported by the first bracket 166. Likewise, one end of the third elastic member 169 may be supported by the second supporter 164, and the other end of the third elastic member 169 may be supported by the second bracket 167.

A method in which the support member 165 fixes the inner case 160 to one inner side of the outer case 170 will be described below.

Figure 6:
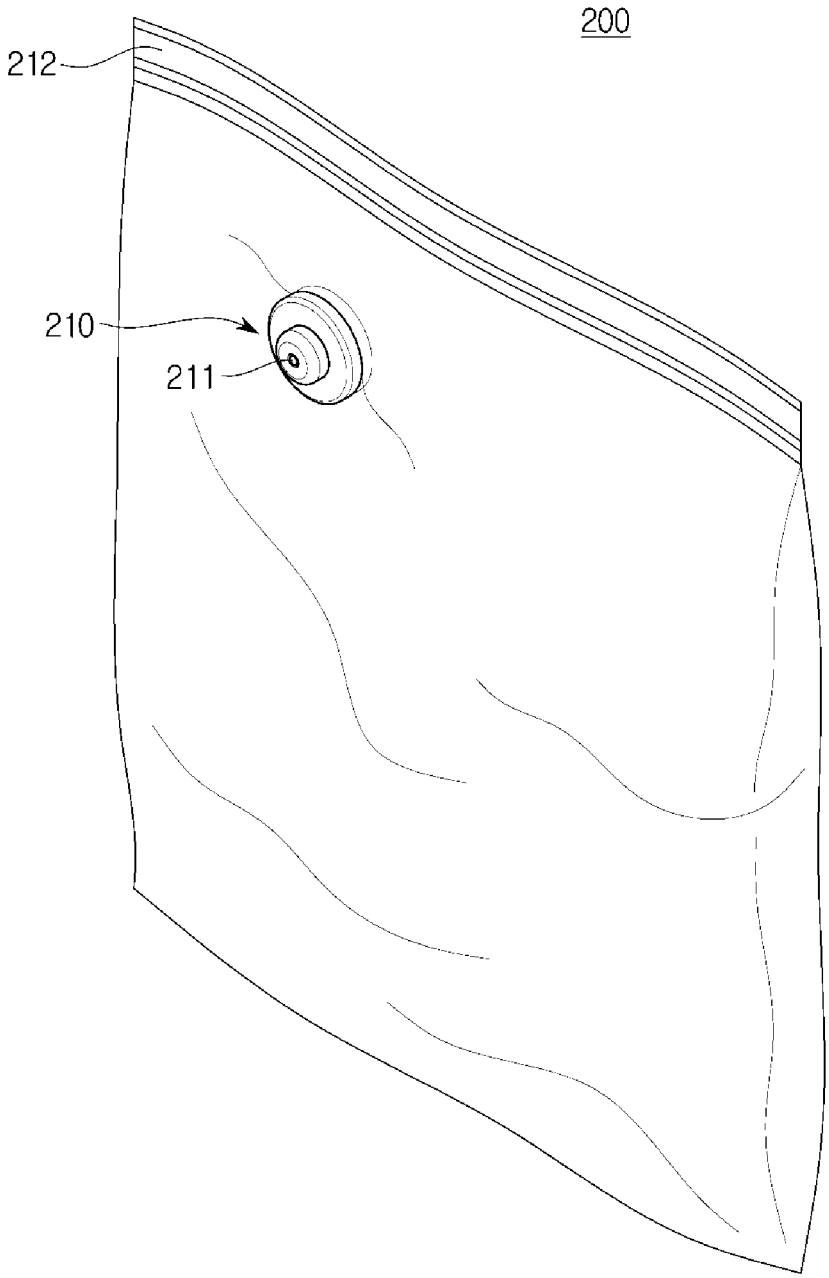
FIG. 6 is a view illustrating a vinyl pack in the refrigerator according to one embodiment of the present disclosure.

FIG. 6 is a view illustrating a vinyl pack in the refrigerator according to one embodiment of the present disclosure.

As shown in FIG. 6, the vinyl pack 200 may include the check valve 210 and a zipper 212.

The vinyl pack 200 may be sealed and opened by the zipper 212 provided on an upper end thereof. After putting food in the vinyl pack 200 when the vinyl pack 200 is open, the vinyl pack 200 may be sealed using the zipper 212. When the vinyl pack 200 is sealed, a flow of air between an inside and an outside of the vinyl pack 200 may be prevented.

However, although the vinyl pack 200 is sealed, some air may remain in the vinyl pack 200. The air may be in contact with the food so that the food may rot. The vacuum packing device 100 may suction the air in the vinyl pack 200 so that the air in the vinyl pack 200 may be removed, as will be described below. Accordingly, most air in contact with the food may not remain in the vinyl pack 200 so that freshness of the food may be maintained for a long time when the vinyl pack 200 in the above state is stored in a refrigerator.

The vinyl pack 200 may include the check valve 210. The check valve 210 may be provided such that air flows in one direction. That is, since the check valve 210 is provided, the air in the vinyl pack 200 may leak to an outside of the opening and closing hole 211. However, air outside the vinyl pack 200 is prevented from being introduced into the opening and closing hole 211.

Meanwhile, the vinyl pack 200 in FIG. 6 is only one example, and the vinyl pack 200 is not limited thereto. That is, the vinyl pack has no limitation on a material or a size thereof. Further, the vinyl pack is not limited to a vinyl material due to the name thereof. In addition, a location of the zipper 212 and a location of the check valve 210 may be changed. In addition, the check valve 210 has no limitation on a structure thereof.

Figure 7:
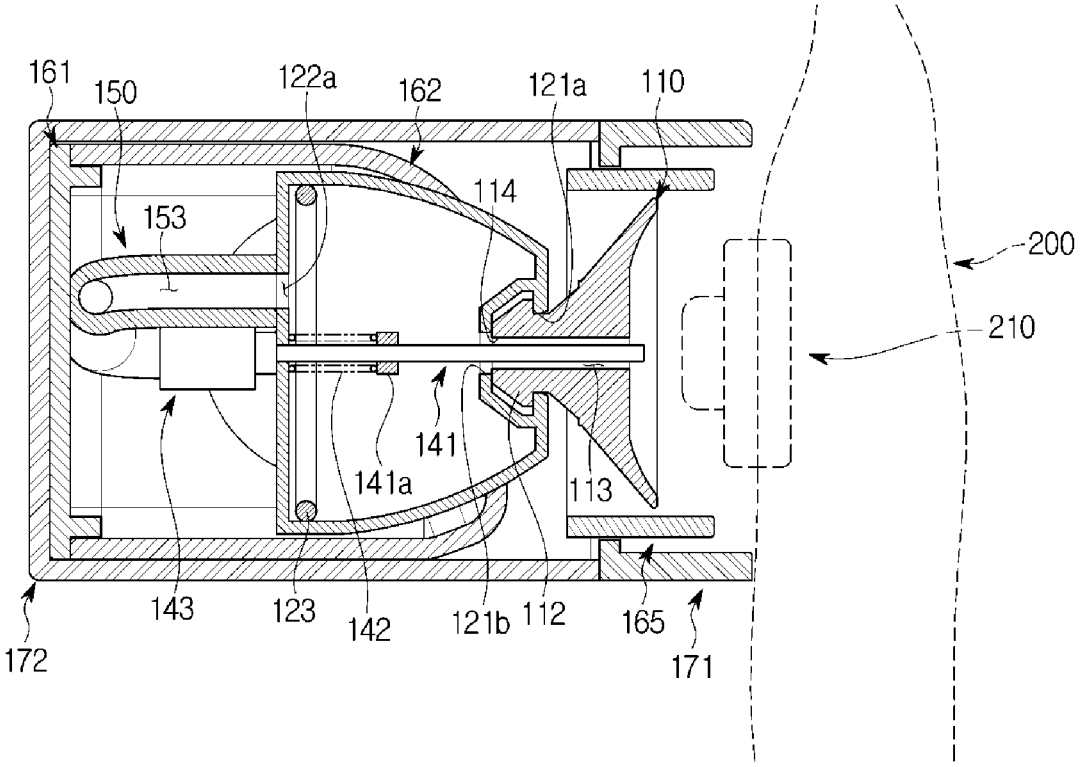
FIG. 7 is a cross-sectional view illustrating the vacuum packing device in the refrigerator according to one embodiment of the present disclosure.
Figure 8:
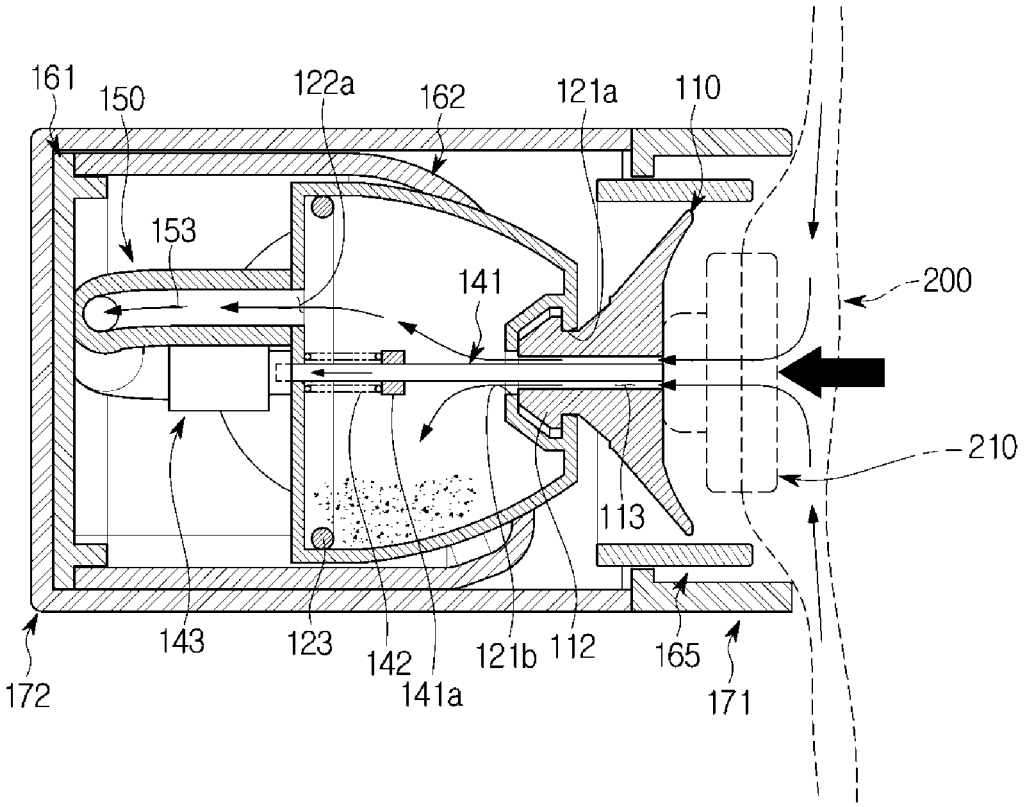
FIG. 8 is a view in which the vacuum packing device illustrated in FIG. 7 suctions air in the vinyl pack.

FIG. 7 is a cross-sectional view illustrating the vacuum packing device in the refrigerator according to one embodiment of the present disclosure. FIG. 8 is a view in which the vacuum packing device illustrated in FIG. 7 suctions air in the vinyl pack.

Hereinafter, an operation of the vacuum packing device will be described in detail with reference to FIGS. 7 and 8.

As shown in FIG. 7, a state in which the button 141 protrudes to the outside of the suction port 111 may be maintained before the vacuum packing device 100 operates. This is because the button 141 receives an elastic force from the first elastic member 142 to protrude to the outside of the suction port 111.

The button 141 may pass through the suction port 111, the first path 113, the discharge port 114, and the first opening 121B. Further, the button 141 may pass through the third opening 122B. Since the button 141 may be provided in the bar shape, centers of the third opening 122B, the discharge port 114, the first opening 121B, and the suction port 111 may be provided to match each other such that the first opening 121B and the third opening 122B are axially aligned.

As shown in FIG. 8, when a user desires to remove air in the vinyl pack 200, the check valve 210 may be brought into contact with the suction head 110 after the vinyl pack 200 is sealed by the zipper 212. Specifically, the opening and closing hole 211 of the check valve 210 is brought into contact with the button 141 so that the vinyl pack 200 is directly connected to the suction head 110.

In this case, the button 141 configured to protrude to the outside of the suction port 111 may be inserted into the suction port 111. Since the button 141 is inserted into the suction port 111, the switch 143 may operate the vacuum pump 130.

When the vacuum pump 130 operates, the vacuum pump 130 starts to suction air. Accordingly, the vacuum pump 130 may suction air from the tube 150 connected to the vacuum pump 130, the chamber 120 connected to the tube 150, and the suction head 110 connected to the chamber 120.

That is, the air in the vinyl pack 200 starts to be suctioned through the suction port 111 and may be introduced into the chamber 120 through the first path 113 and the first opening 121B. As shown in FIG. 8, when a foreign substance in the vinyl pack 200 is suctioned into the chamber 120 with the air, the foreign substance is collected in the chamber 120. This is because the second opening 122A is provided at a higher level than the first opening 121B. According to the aspect of the present disclosure, the second opening 122A of the chamber 120 may be provided at a higher level than the first opening 121B. Accordingly, as described above, the foreign substance suctioned through the suction head 110 is not introduced into the vacuum pump 130 through the tube 150 and collected in the chamber 120. This is because the possibility of performance degradation or failure of the vacuum pump 130 may be increased when the foreign substance is introduced into the vacuum pump 130.

When the second opening 122A is located at the higher level than the first opening 121B, a large suction force sufficient to draw the foreign substance from the first opening 121B to the second opening 122A is necessary for the foreign substance to be introduced into the second opening 122A. According to an aspect of the present disclosure, the vacuum pump 130 needs only a suction force which suctions the air in the vinyl pack 200. Accordingly, since the vacuum pump 130 doesn't have the above large suction force, the foreign substance may be prevented from being introduced into the vacuum pump 130 through the second opening 122A.

Accordingly, after the air and the foreign substance in the vinyl pack 200 pass through the first path 113 and reach the chamber 120 through the suction port 111, the foreign substance may remain in the chamber 120 and the air may pass through the second opening 122A and the second path 153 to be suctioned into the vacuum pump 130. The air suctioned into the vacuum pump 130 may leak to the outside of the door through a gap in the inner case 160 and the outer case 170.

A user may vacuum-pack the vinyl pack 200 by separating the vacuum pump 130 from the suction head 110 after the vacuum pump 130 completely suctions the air in the vinyl pack 200. Further, the check valve 210 is separated from the suction head 110 and does not press the button 141 anymore. Accordingly, the button 141 protrudes to the outside of the suction port 111 due to the elastic force of the first elastic member 142 and may be restored to an original state thereof as shown in FIG. 7.

Figure 9:
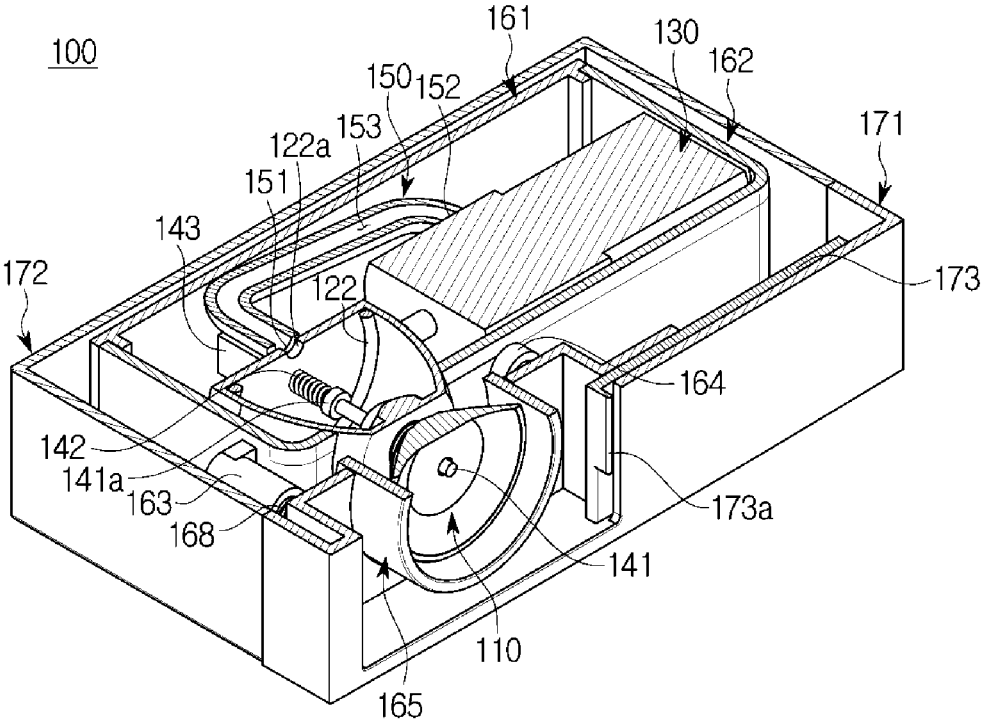
FIG. 9 is a cross-sectional perspective view of the vacuum packing device in the refrigerator according to one embodiment of the present disclosure.

FIG. 9 is a cross-sectional perspective view of the vacuum packing device in the refrigerator according to one embodiment of the present disclosure.

Hereinafter, a method in which the support member 165 fixes the inner case 160 to the one side of the outer case 170 will be described in detail. Further, a method of disassembling the vacuum packing device 100 to remove a foreign substance in the chamber 120 will be described in detail.

As shown in FIG. 5, the first supporter 163 and the second supporter 164 may be provided in the second inner case 162. Further, the first bracket 166 and the second bracket 167 may be provided on the support member 165. In this case, the second elastic member 168 may be disposed between the first bracket 166 and the first supporter 163, and the third elastic member 169 may be disposed between the second bracket 167 and the second supporter 164.

Accordingly, each of the second elastic member 168 and the third elastic member 169 may provide an elastic force in a direction in which a distance between the support member 165 and the inner case 160 increases.

In this case, a part of the support member 165 may pass through the opening part 162A of the second inner case 162, and the first bracket 166 and the second bracket 167 may come into contact with and be supported by the first outer case 171. That is, the support member 165 may not pass through the first outer case 171 because the first and second brackets 166 and 167 come into contact with the first outer case 171.

Meanwhile, the inner case 160 may receive a force in a direction away from the support member 165 due to the elastic forces of the second elastic member 168 and the third elastic member 169. Accordingly, the inner case 160 is moved by the elastic forces until the inner case 160 comes into contact with the rear surface of the outer case 170 and is not moved anymore after a rear surface thereof comes in contact with the rear surface of the outer case 170. Accordingly, the inner case 160 may be fixed by the support member 165 and the second and third elastic members 168 and 169 so that a state in which the rear surface of the inner case 160 is in contact with the rear surface of the outer case 170 is maintained. Accordingly, a state in which the inner case 160 is fixed in the outer case 170 may be maintained without a separate coupling member.

In order to remove a foreign substance in the chamber 120, the first outer case 171 may be separated from the second outer case 172. When the first outer case 171 is separated from the second outer case 172, the support member 165 is also separated therefrom, and the inner case 160 may be withdrawn from the outer case 170. After the inner case 160 is withdrawn from the outer case 170, the first inner case 161 and the second inner case 162 are separated from each other, and the chamber 120 in the inner case 160 may be withdrawn from an inside of the first inner case 161 and the second inner case 162. The chamber plate 122 may be separated from the chamber 120 and an inside of the chamber 120 may be cleaned.

Meanwhile, when the chamber body 121 and the chamber plate 122 are integrally formed to form the chamber 120 without being separated from each other, the inside of the chamber 120 may be cleaned through the insertion port 121A by separating the suction head 110, which is formed of the flexible material and forcibly insertion-coupled to the chamber 120, from the chamber 120.

FIG. 10 is a view illustrating an exterior of a refrigerator according to another embodiment of the present disclosure.

Hereinafter, a case in which a vacuum packing device is installed in a refrigerator door provided with a dispenser will be described.

As shown in FIG. 10, a refrigerator 1 may include a body 10, and doors 11A, 11B, 12A, and 12B rotatably coupled to the body 10.

Refrigerator compartment doors 11A and 11B may be provided to open and close a refrigerator compartment (not shown). Freezer compartment doors 12A and 12B may be provided to open and close a freezer compartment (not shown). Further, refrigerator compartment handles 11C and 11D may be provided on the refrigerator compartment doors 11A and 11B, and freezer compartment handles 12C and 12D may be provided on the freezer compartment doors 12A and 12B.

A dispenser 30 capable of dispensing ice and water to the outside without the refrigerator compartment door 11A being opened may be provided in the refrigerator compartment door 11A. A lever 31 capable of selecting whether ice is dispensed may be provided in the dispenser 30.

In this case, according to another embodiment of the present disclosure, a vacuum packing device 100 may be disposed at one side of the dispenser 30. Specifically, parts of a cover door 173 and an outer case 170 may be disposed to be exposed at the one side of the dispenser 30.

Generally, the dispenser 30 is disposed at a location at which a hand of a user can easily touch the dispenser 30 so that the user can conveniently receive water or ice. Since the vacuum packing device 100 is disposed at the one side of the dispenser 30, a user may also remove air in a vinyl pack 200 at a location at which the hand of the user can conveniently touch the vacuum packing device 100. Accordingly, convenience for the user can be improved.

Figure 11:
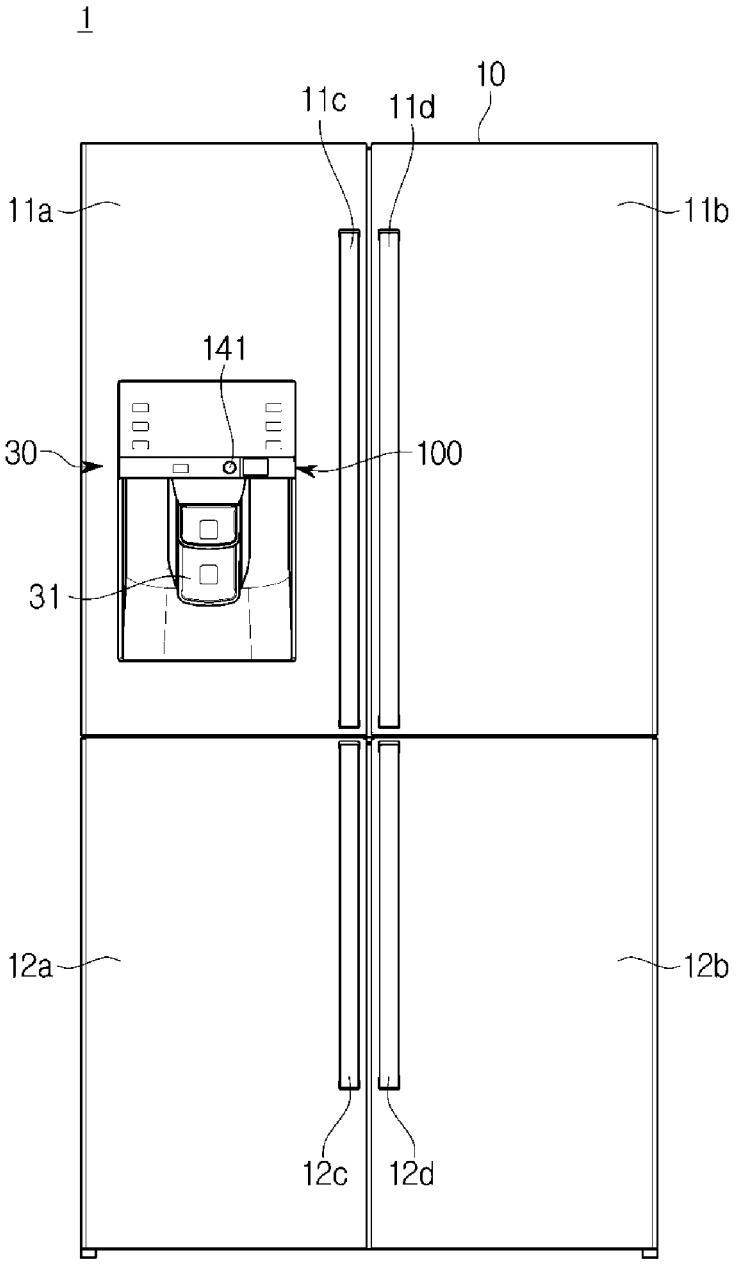
FIG. 11 is a view illustrating an exterior of a refrigerator according to still another embodiment of the present disclosure.

FIG. 11 is a view illustrating an exterior of a refrigerator according to still another embodiment of the present disclosure.

As shown in FIG. 11, a switch module 140 may be provided with a button 141 separately provided on an outside of a vacuum packing device 100. The button 141 may be provided to turn a vacuum pump 130 on and off, and the vacuum pump 130 may be turned on and off in various ways. For example, the vacuum pump 130 may be provided to turn on and operate when the button 141 is pressed, and may be provided to turn off and stop when the button 141 is pressed again. Otherwise, the vacuum pump 130 may be provided to operate only while a user presses the button 141.

The button 141 may be disposed at one side of a refrigerator compartment door 11A. For example, the button 141 may be disposed at one side of a dispenser 30. A location at which the button 141 is disposed is not limited, and the button 141 may be preferably disposed adjacent to the vacuum packing device 100 for convenience of the user.

As is apparent from the above description, a refrigerator including a vacuum packing device can be provided.

A refrigerator including a vacuum packing device directly connected to a vinyl pack without a separate hose and configured to remove air in the vinyl pack can be provided.

A refrigerator including a vacuum packing device operated only by a contact with a vinyl pack and ensuring ease of use can be provided.

A refrigerator including a vacuum packing device configured to prevent a foreign substance in a vinyl pack from being suctioned into a vacuum pump with air can be provided.

Although a few embodiments of the present disclosure have been shown and described, it should be appreciated by those skilled in the art that changes may be made to the embodiments without departing from the principles and spirit of the disclosure, and the scope of the disclosure is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body; and a vacuum packing device provided in the body and configured to suction air in a vinyl pack to store a food, wherein the vacuum packing device includes:

a vacuum pump provided to suction the air;

a switch module provided to control an operation of the vacuum pump;

a suction head including a first path directly connected to the vinyl pack and configured to suction the air; and a chamber including a first opening connected to the first path and provided to collect a foreign substance suctioned through the suction head, wherein the chamber further includes a second opening connected to the vacuum pump to discharge the air introduced into the first opening and provided at a higher level than the first opening, and a third opening axially aligned with the first opening, wherein the first opening is formed in a front of the chamber and the second and third openings are formed in a rear of the chamber, and wherein the switch module includes a button configured to pass through the first opening and the third opening and protrude to an outside of the suction head.

2. The refrigerator of the claim 1, wherein the vacuum pump is provided to operate when the button is pressed.

3. The refrigerator of the claim 2, wherein the switch module further includes an elastic member configured to elastically bias the button to protrude to the outside of the suction head.

4. The refrigerator according to the claim 2, wherein a diameter of the first path is provided to be greater than a diameter of the button so that the air flows in a space between the first path and the button.

5. The refrigerator according to the claim 1, wherein the vacuum packing device further comprises a tube configured to connect the chamber and the vacuum pump while forming a second path connected to the second opening.

6. The refrigerator according to the claim 5, wherein:

the tube includes an inlet into which the air is introduced and an outlet from which the air is discharged; and a first direction in which the air is introduced into the inlet is opposite a second direction in which the air is discharged from the outlet.

7. The refrigerator of the claim 1, wherein the first opening is formed in one surface of the chamber and the second opening is formed in another surface thereof opposite the one surface.

8. The refrigerator according to the claim 1, further comprising a door including a dispenser provided to supply water and rotatably coupled to the body, wherein the vacuum packing device is provided at one side of the dispenser.

9. The refrigerator according to the claim 1, wherein the suction head is detachably coupled to the chamber so that the foreign substance is removable in the chamber.

10. The refrigerator according to the claim 9, wherein the suction head includes an elastic material and is coupled to the chamber by insertion.

11. The refrigerator according to the claim 1, wherein the vacuum packing device further includes:

an inner case in which the vacuum pump, the chamber, and the switch module are disposed; and an outer case in which the inner case and the suction head are disposed, wherein the outer case includes a cover door provided to be slidable in front of the suction head.

12. The refrigerator according to the claim 11, wherein:

the vacuum packing device further includes a support member provided to fix the inner case to an inner side of the outer case; and the support member includes brackets provided on both sides of the support member and an elastic member disposed between the brackets and the inner case.

13. The refrigerator according to the claim 1, wherein the button is provided to turn the vacuum pump on and off.

14. A refrigerator comprising:

a body;

a door rotatably coupled to the body; and a vacuum packing device provided in the door and configured to suction air in a vinyl pack having a check valve, wherein the vacuum packing device includes:

a vacuum pump;

a suction head configured to suction the air in the vinyl pack;

a chamber including a first opening connected to the suction head so that the air suctioned through the suction head flows in the suction head, and a second opening connected to the vacuum pump to discharge the air introduced into the first opening and provided at a higher level than the first opening, and a third opening axially aligned with the first opening;

a tube configured to connect the chamber and the vacuum pump and connected to the second opening; and a switch module provided to control an operation of the vacuum pump, wherein the first opening is formed in a front of the chamber and the second and third openings are formed in a rear of the chamber, and wherein the switch module includes a button configured to pass through the first opening and the third opening and protrude to an outside of the suction head.

15. The refrigerator according to the claim 14, wherein the suction head is provided to be directly connected to the check valve.

16. The refrigerator according to the claim 14, wherein the vacuum pump is provided to operate when the button is pressed.

17. The refrigerator according to the claim 14, wherein:

the door further includes a dispenser provided to supply water to an outside of the door; and the suction head is disposed on the dispenser.

18. A refrigerator comprising a vacuum packing device provided to suction air in a vinyl pack, wherein the vacuum packing device includes:

a vacuum pump;

a suction head directly connected to the vinyl pack and provided to suction the air;

a chamber including a first opening connected to the suction head so that the air suctioned through the suction head flows in the suction head, and a second opening connected to the vacuum pump to discharge the air introduced into the first opening and provided at a higher level than the first opening, and a third opening axially aligned with the first opening; and a switch module including a button configured to pass through the first opening and the third opening and protrude to an outside of the suction head, and provided to operate the vacuum pump when the button is pressed, wherein the first opening is formed in a front of the chamber and the second and third openings are formed in a rear of the chamber.

* * * * *